US011571030B1

(12) United States Patent
Jones

(10) Patent No.: US 11,571,030 B1
(45) Date of Patent: Feb. 7, 2023

(54) ILLUMINATING FACE PROTECTION DEVICE

(71) Applicant: Michael Jones, Seymour, MO (US)

(72) Inventor: Michael Jones, Seymour, MO (US)

( * ) Notice: Subject to any disclaimer, the term of this patent is extended or adjusted under 35 U.S.C. 154(b) by 0 days.

(21) Appl. No.: 17/529,613

(22) Filed: Nov. 18, 2021

(51) Int. Cl.

| | |
|---|---|
| ***F21V 14/00*** | (2018.01) |
| ***A41D 13/11*** | (2006.01) |
| ***F21V 21/084*** | (2006.01) |
| ***F21V 14/02*** | (2006.01) |
| ***F21V 23/04*** | (2006.01) |

(52) U.S. Cl.
CPC ..... *A41D 13/1161* (2013.01); *F21V 14/02* (2013.01); *F21V 21/084* (2013.01); *F21V 23/0471* (2013.01)

(58) Field of Classification Search
CPC .... F21V 23/0471; F21V 21/084; F21V 14/02; F21L 15/14; A41D 13/1218; A41D 13/1161; A42B 3/0446; A42B 3/044; A42B 3/18
See application file for complete search history.

(56) References Cited

U.S. PATENT DOCUMENTS

| | | | | |
|---|---|---|---|---|
| 5,408,393 | A * | 4/1995 | Becker | F21V 21/084 362/105 |
| 5,438,494 | A * | 8/1995 | Harlan | A42B 3/044 362/106 |
| 2012/0224356 | A1* | 9/2012 | Fischer | A42B 3/044 362/106 |
| 2015/0109769 | A1* | 4/2015 | Chang | F21V 21/145 362/191 |
| 2015/0198313 | A1* | 7/2015 | Rementer | F21V 21/084 362/105 |

* cited by examiner

*Primary Examiner* — Y M. Quach Lee
(74) *Attorney, Agent, or Firm* — The Iwashko Law Firm, PLLC; Lev Ivan Gabriel Iwashko

(57) ABSTRACT

An illuminating face protection device, including a main body to be worn on a head of a user and protect a face of the user, a top illuminating unit disposed on at least a portion of the main body to emit a first beam of light and illuminate a surrounding area, a first side illuminating unit disposed on at least a portion of the main body to emit a second beam of light and illuminate the surrounding area, and a second side illuminating unit disposed on at least a portion of the main body to emit a third beam of light and illuminate the surrounding area.

5 Claims, 4 Drawing Sheets

ILLUMINATING FACE PROTECTION DEVICE

BACKGROUND

1. Field

The present general inventive concept relates generally to a face shield, and particularly, to an illuminating face protection device.

2. Description of the Related Art

Some environments have low light and/or dark conditions that can make traversing the environment difficult and potentially dangerous. For example, working in areas to grind metal and/or other materials, caves, and/or mines require an artificial source of light.

Some helmets have a single light, but lack customization and are limited in a size of an area it can illuminate with the single light. Additionally, current face shields in the market offer protection from flying debris and other project hazards, but they do not improve visibility in such conditions due to the lack of a light source.

Therefore, there is a need for a face protection device that also provides multiple sources of light.

SUMMARY

The present general inventive concept provides an illuminating face protection device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an illuminating face protection device, including a main body to be worn on a head of a user and protect a face of the user, a top illuminating unit disposed on at least a portion of the main body to emit a first beam of light and illuminate a surrounding area, a first side illuminating unit disposed on at least a portion of the main body to emit a second beam of light and illuminate the surrounding area, and a second side illuminating unit disposed on at least a portion of the main body to emit a third beam of light and illuminate the surrounding area.

The illuminating face protection device may further include a sensor disposed on and within at least a portion of the main body to track movement of eyes of the user and send a signal to the top illuminating unit, the first side illuminating unit, and the second side illuminating unit to move in a direction of viewing by the eyes.

The top illuminating unit, the first side illuminating unit, and the second side illuminating unit each may include a motor, such that the top illuminating unit, the first side illuminating unit, and the second side illuminating unit move based on the signal from the sensor and in response to rotation of the motor.

The illuminating face protection device may further include a protecting panel removably connected to at least a portion of the main body to cover a face of the user.

The illuminating face protection device may further include an adjustable strap disposed on at least a portion of the main body to accommodate a size of the head of the user in response to adjusting a length of the adjustable strap.

The illuminating face protection device may further include a power button disposed on at least a portion of the main body to turn on the top illuminating unit in response to depressing the power button a first time, turn on the first side illuminating unit and the second side illuminating unit in response to depressing the power button a second time, turn off the top illuminating unit while the first side illuminating unit and the second side illuminating unit remain on in response to depressing the power button a third time, and turn off the first side illuminating unit and the second side illuminating unit in response to depressing the power button a fourth time.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
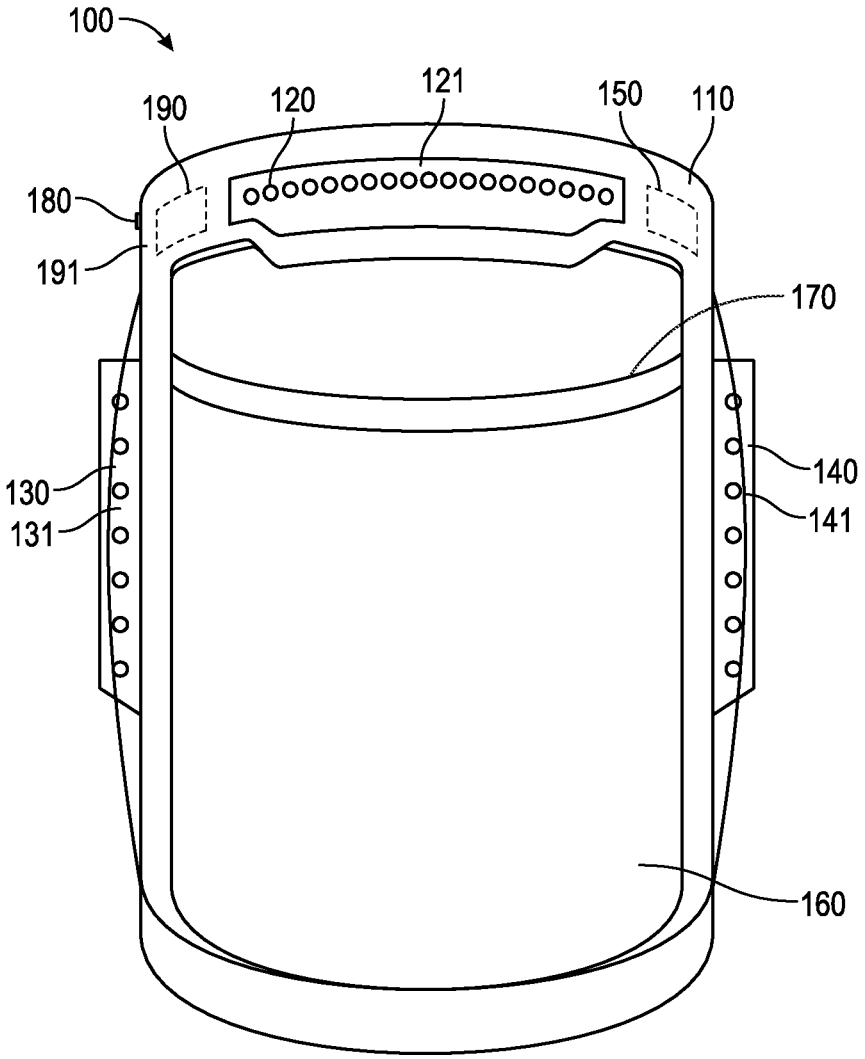
FIG. 1 illustrates a front perspective view of an illuminating face protection device, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

List of Components

Illuminating Face Protection Device 100
Main Body 110
Top Illuminating Unit 120
Top Motor 121
First Side Illuminating Unit 130
First Motor 131
Second Side Illuminating Unit 140
Second Motor 141
Sensor 150
Protecting Panel 160
Adjustable Strap 170
Buckle 171
Power Button 180
Power Source 190
Charging Port 191

FIG. 1 illustrates a front perspective view of an illuminating face protection device 100, according to an exemplary embodiment of the present general inventive concept.

Figure 2:
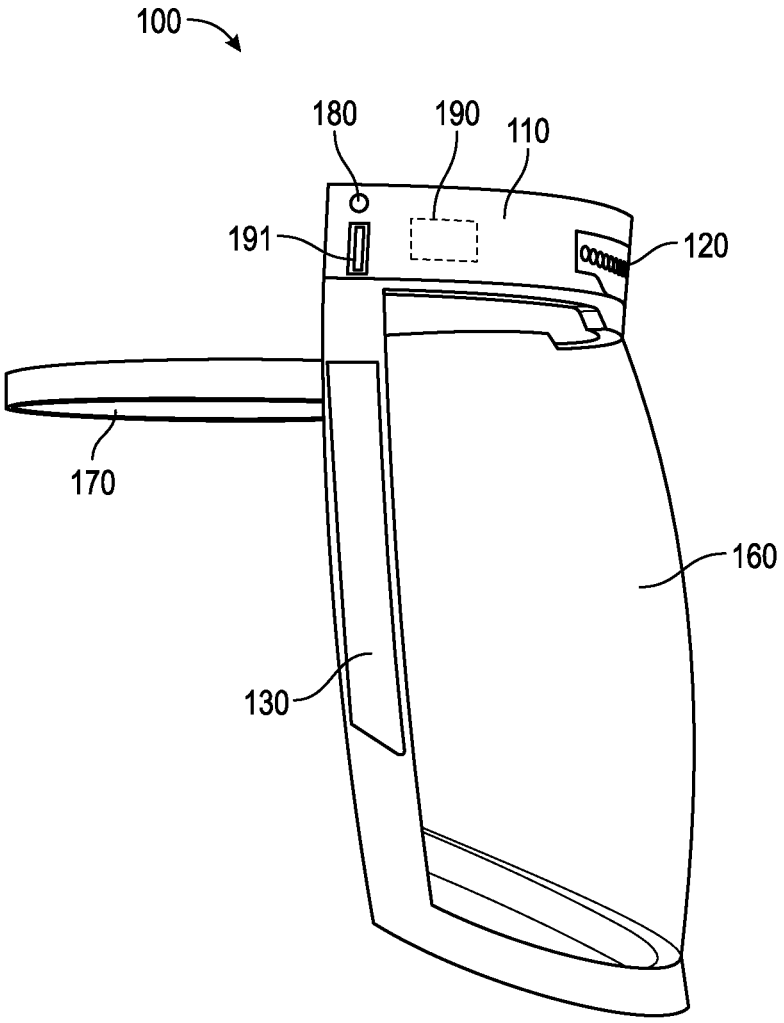
FIG. 2 illustrates a side perspective view of the illuminating face protection device, according to an exemplary embodiment of the present general inventive concept.

FIG. 2 illustrates a side perspective view of the illuminating face protection device 100, according to an exemplary embodiment of the present general inventive concept.

The illuminating face protection device 100 may be constructed from at least one of metal, plastic, glass, wood, and rubber, etc., but is not limited thereto.

The illuminating face protection device 100 may include a main body 110, a top illuminating unit 120, a first side illuminating unit 130, a second side illuminating unit 140, a sensor 150, a protecting panel 160, an adjustable strap 170, a power button 180, and a power source 190, but is not limited thereto.

Referring to FIGS. 1 and 2, the main body 110 is illustrated to be a face shield. However, the main body 110 may be constructed as a face mask, a helmet, a hat, a cap, an eyewear, a pair of goggles, and/or a pair of glasses, but is not limited thereto.

The main body 110 may be rigid and/or flexible. For example, a top portion of the main body 110 may be rigid, and a bottom portion of the main body 110 may be flexible, such that the bottom portion of the main body 110 may at least partially deform (i.e., bend, flex, stretch, expand) in response to an application of force thereto. As such, the main body 110 may have a fixed size and/or be able to accommodate a size of a head of a user.

The top illuminating unit 120 may be constructed as a light using an incandescent bulb, a fluorescent bulb, and a light-emitting diode (LED), but is not limited thereto. Referring again to FIG. 1, the top illuminating unit 120 is illustrated as a thin matrix of lights. However, the top illuminating unit 120 may be a single light, a rod of light, and/or any combination thereof, but is not limited thereto.

The top illuminating unit 120 may include a top motor 121, but is not limited thereto.

The top illuminating unit 120 may be movably (i.e., pivot, rotate) disposed on at least a portion of the top portion of the main body 110. More specifically, the top illuminating unit 120 may pivot within the main body 110, such that the top illuminating unit 120 may be oriented toward any direction away from where the top illuminating unit 120 is disposed. Moreover, the top illumination unit 120 may at least partially illuminate a surrounding area of the main body 110 and/or emit a first beam of light in at least one direction away from the top illuminating unit 120.

The top motor 121 may be disposed within at least a portion of the main body 110 and/or connected to the top illuminating unit 120.

The first side illuminating unit 130 may be constructed as a light using an incandescent bulb, a fluorescent bulb, and a light-emitting diode (LED), but is not limited thereto. Referring again to FIG. 1, the first side illuminating unit 130 is illustrated as a thin matrix of lights. However, the first side illuminating unit 130 may be a single light, a rod of light, and/or any combination thereof, but is not limited thereto.

The first side illuminating unit 130 may include a first motor 131, but is not limited thereto.

The first side illuminating unit 130 may be movably (i.e., pivot, rotate) disposed on at least a portion of a first side of the main body 110. More specifically, the first side illuminating unit 130 may pivot within the main body 110, such that the first side illuminating unit 130 may be oriented toward any direction away from where the first side illuminating unit 130 is disposed. Moreover, the first side illuminating unit 130 may at least partially illuminate a surrounding area of the main body 110 and/or emit a second beam of light in at least one direction away from the first side illuminating unit 130. Furthermore, the first side illuminating unit 130 may be disposed on a first protruding surface of the main body 110, such that the first side illuminating unit 130 being oriented toward a center of the main body 110 may illuminate toward the center of the main body 110.

The first motor 131 may be disposed within at least a portion of the main body 110 and/or connected to the first side illuminating unit 130.

The second side illuminating unit 140 may be constructed as a light using an incandescent bulb, a fluorescent bulb, and a light-emitting diode (LED), but is not limited thereto. Referring again to FIG. 1, the second side illuminating unit 140 is illustrated as a thin matrix of lights. However, the second side illuminating unit 140 may be a single light, a rod of light, and/or any combination thereof, but is not limited thereto.

The second side illuminating unit 140 may include a second motor 141, but is not limited thereto.

The second side illuminating unit 140 may be movably (i.e., pivot, rotate) disposed on at least a portion of a second side of the main body 110 opposite with respect to the first side of the main body 110. More specifically, the second side illuminating unit 140 may pivot within the main body 110, such that the second side illuminating unit 140 may be oriented toward any direction away from where the second side illuminating unit 130 is disposed. Moreover, the second side illuminating unit 140 may at least partially illuminate a surrounding area of the main body 110 and/or emit a third beam of light in at least one direction away from the second side illuminating unit 140. Furthermore, the second side illuminating unit 140 may be disposed on a second protruding surface of the main body 110, such that the second side illuminating unit 140 being oriented toward the center of the main body 110 may illuminate toward the center of the main body 110.

The second motor 141 may be disposed within at least a portion of the main body 110 and/or connected to the second side illuminating unit 140.

The sensor 150 may be disposed on and/or within at least a portion of the main body 110. The sensor 150 may be configured to track a movement of eyes of the user. Moreover, the top illuminating unit 120, the first side illuminating unit 130, and/or the second side illuminating unit 140 may move in at least one direction in which the eyes of the user are looking. Additionally, the top motor 121, the first motor 131, and/or the second motor 141 may rotate to move the top illuminating unit 120, the first side illuminating unit 130, and/or the second side illuminating unit 140, respectively, in response to a signal from the sensor 150 based on a direction of viewing by the eyes. In other words, the top illuminating unit 120, the first side illuminating unit 130, and/or the second side illuminating unit 140 may follow the eyes of the user to direct the first beam of light, the second beam of light, and/or the third beam of light in the same direction in which the eyes are viewing to facilitate viewing in a low light and/or a dark environment. Therefore, the top illuminating unit 120, the first side illuminating unit 130, and/or the second side illuminating unit 140 may automatically move based on the signal from the sensor 150.

Figure 3:
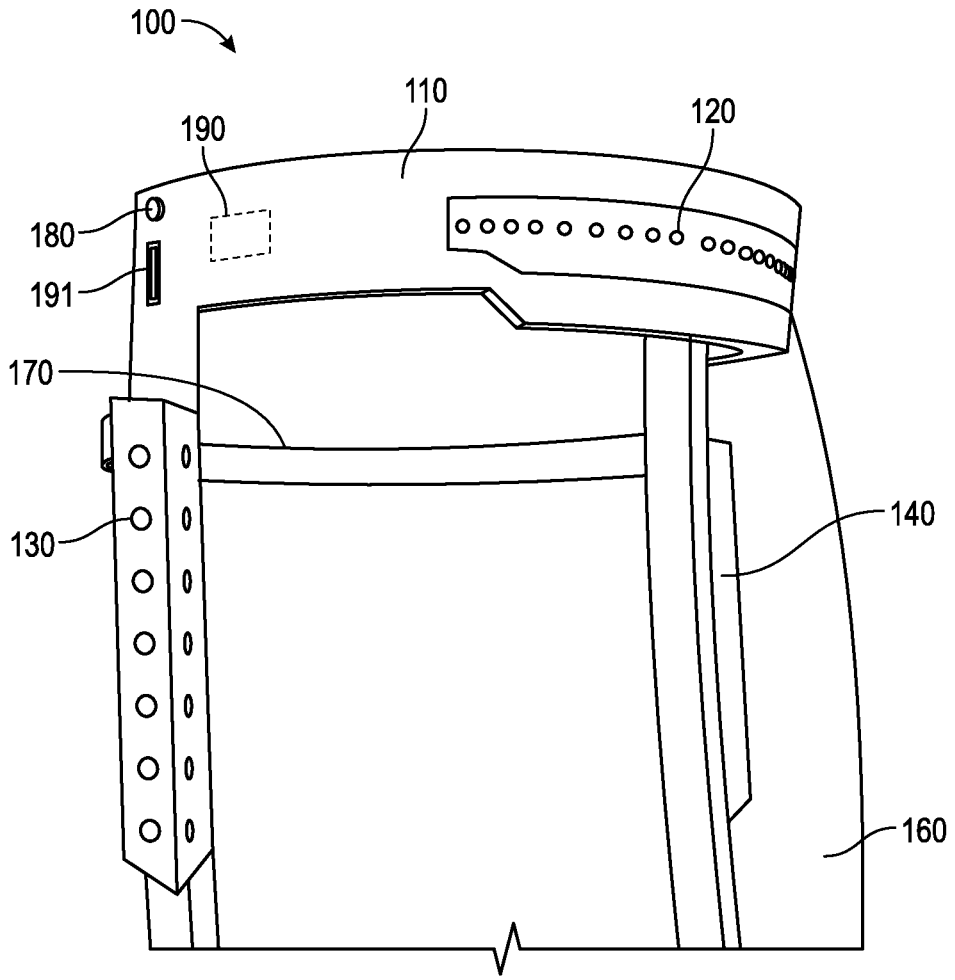
FIG. 3 illustrates a zoomed in view of a side of the illuminating face protection device, according to an exemplary embodiment of the present general inventive concept.

FIG. 3 illustrates a zoomed in view of a side of the illuminating face protection device 100, according to an exemplary embodiment of the present general inventive concept.

Figure 4:
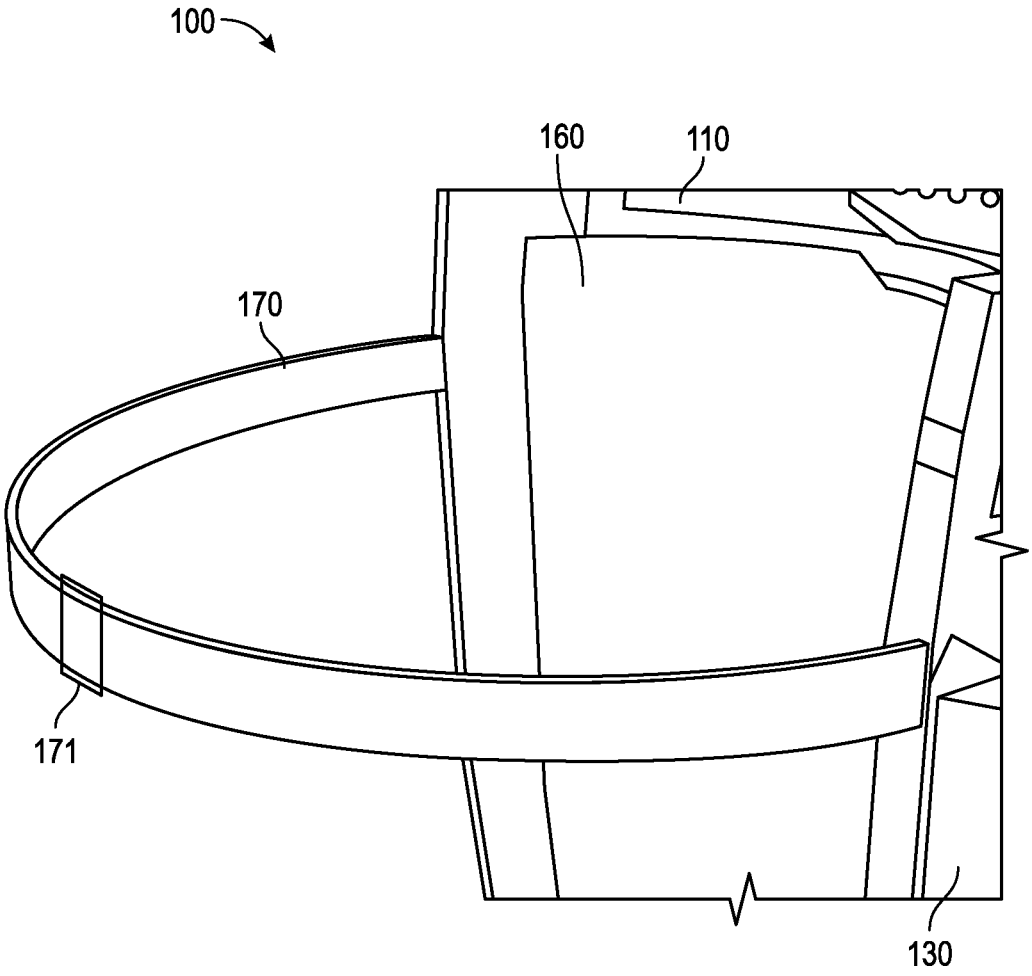
FIG. 4 illustrates a zoomed in rear view of the illuminating face protection device, according to an exemplary embodiment of the present general inventive concept.

FIG. 4 illustrates a zoomed in rear view of the illuminating face protection device 100, according to an exemplary embodiment of the present general inventive concept.

The protecting panel 160 may be constructed from at least one of glass and plastic, but is not limited thereto.

The protecting panel 160 may be removably connected to at least a portion of the main body 110. More specifically, the protecting panel 160 may be slotted within grooves on at least a portion of a center portion of the main body 110 using at least one fastener, such as a clip, a clamp, a clasp, a magnet, and/or any combination thereof. Moreover, the protecting panel 160 may be connected to the main body 110 without using tools and/or external fasteners (e.g., screw, nail, bolt, washer, nut, etc.). Accordingly, the main body 110 may provide a quick connection to the protecting panel 160 that saves time compared to using tools to remove the external fasteners. As such, the protecting panel 160 may cover at least a portion of a face of the user and prevent debris, dirt, and/or at least one object from moving therethrough and contacting the face of the user, such that the face of the user is protected.

Referring to FIGS. 2 and 3, the protecting panel 160 is illustrated to be convex (i.e., curved) with respect to a front of the main body 110 to provide more space for the face of the user. However, the protecting panel 160 may be flat based on a preference of the user.

The adjustable strap 170 may include a buckle 171, but is not limited thereto.

The adjustable strap 170 may be disposed on at least a portion of a rear of the main body 110. A first portion of the adjustable strap 170 may removably connect to a least a second portion of the adjustable strap 170. Moreover, the adjustable strap 170 may be threaded through the buckle 171 disposed on at least a portion thereof to adjust a length of the adjustable strap 170. Accordingly, the length of the adjustable strap 170 may be adjusted to accommodate a size (i.e., a fit) of the head of the user, such that the main body 110 may be worn on the head of the user.

The power button 180 may be disposed on at least a portion of the main body 110. The top illuminating unit 120 may turn on in response to depressing the power button 180 a first time. The first side illuminating unit 130 and/or the second side illuminating unit 140 may turn on in response to depressing the power button 180 a second time. The top illuminating unit 120 may turn off while the first side illuminating unit 130 and/or the second side illuminating unit 140 remain on in response to depressing the power button 180 a third time. Finally, the first side illuminating unit 130 and/or the second side illuminating unit 140 may turn off in response to depressing the power button 180 a fourth time, such that all top illuminating unit 120, the first side illuminating unit 130, and/or the second side illuminating unit 140 may be off. Accordingly, the steps described above with respect to the power button 180 may repeat in the same manner after the power button 180 is depressed the fourth time.

It is important to note that additional steps may be added, such as the first side illuminating unit 130 remaining on while the second side illuminating unit 140 turns off in response to depressing the power button 180. In other words, other combinations of turning on and/or turning off the top illuminating unit 120, the first side illuminating unit 130, and/or the second side illuminating unit 140 may be configured based on depressing the power button 180.

The power source 190 may include a charging port 191, but is not limited thereto. Also, the power source 190 may further include a battery (e.g., alkaline, lithium ion, nickel cadmium, etc.) and a solar cell, but is not limited thereto.

The power source 190 may be disposed within at least a portion of the main body 110. The power source 190 may send power to the top illuminating unit 120, the first side illuminating unit 130, the second side illuminating unit 140, the sensor 150, and/or the power button 180.

Additionally, the charging port 191 may be disposed on at least a portion of the main body 110 and/or connected to the power source 190. The charging port 191 may receive and/or removably connect to an external power source, such as a charging cord connect to a power outlet. As such, the charging port 191 may facilitate charging of the power source 190.

Therefore, the illuminating face protection device 100 may provide a plurality of light sources to facilitate viewing in low light and/or dark environments. Additionally, the illuminating face protection device 100 may be customizable in brightness based on a number of the illuminating units that are activated.

The present general inventive concept may include an illuminating face protection device 100, including a main body 110 to be worn on a head of a user and protect a face of the user, a top illuminating unit 120 disposed on at least a portion of the main body 110 to emit a first beam of light and illuminate a surrounding area, a first side illuminating unit 130 disposed on at least a portion of the main body 110 to emit a second beam of light and illuminate the surrounding area, and a second side illuminating unit 140 disposed on at least a portion of the main body 110 to emit a third beam of light and illuminate the surrounding area.

The illuminating face protection device 100 may further include a sensor 150 disposed on and within at least a portion of the main body 110 to track movement of eyes of the user and send a signal to the top illuminating unit 120, the first side illuminating unit 130, and the second side illuminating unit 140 to move in a direction of viewing by the eyes.

The top illuminating unit 120, the first side illuminating unit 130, and the second side illuminating unit 140 each may include a motor (121, 131, 141), such that the top illuminating unit 120, the first side illuminating unit 130, and the second side illuminating unit 140 move based on the signal from the sensor 150 and in response to rotation of the motor (121, 131, 141).

The illuminating face protection device 100 may further include a protecting panel 160 removably connected to at least a portion of the main body 110 to cover a face of the user.

The illuminating face protection device 100 may further include an adjustable strap 170 disposed on at least a portion of the main body 110 to accommodate a size of the head of the user in response to adjusting a length of the adjustable strap 170.

The illuminating face protection device 100 may further include a power button 180 disposed on at least a portion of the main body 110 to turn on the top illuminating unit 120 in response to depressing the power button 180 a first time, turn on the first side illuminating unit 130 and the second side illuminating unit 140 in response to depressing the power button 180 a second time, turn off the top illuminating unit 120 while the first side illuminating unit 130 and the second side illuminating unit 140 remain on in response to depressing the power button 180 a third time, and turn off the first side illuminating unit 130 and the second side illuminating unit 140 in response to depressing the power button 180 a fourth time.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An illuminating face protection device, comprising:

a main body to be worn on a head of a user;

a top illuminating unit disposed on at least a portion of the main body to emit a first beam of light and illuminate a surrounding area;

a first side illuminating unit disposed on at least a portion of the main body to emit a second beam of light and illuminate the surrounding area;

a second side illuminating unit disposed on at least a portion of the main body to emit a third beam of light and illuminate the surrounding area; and a sensor disposed on and within at least a portion of the main body to track movement of eyes of the user and send a signal to the top illuminating unit, the first side illuminating unit, and the second side illuminating unit to move in a direction of viewing by the eyes.

2. The illuminating face protection device of claim 1, wherein the top illuminating unit, the first side illuminating unit, and the second side illuminating unit each comprise a motor, such that the top illuminating unit, the first side illuminating unit, and the second side illuminating unit move based on the signal from the sensor and in response to rotation of the motor.

3. The illuminating face protection device of claim 1, further comprising:

a protecting panel removably connected to at least a portion of the main body to cover a face of the user.

4. The illuminating face protection device of claim 1, further comprising:

an adjustable strap disposed on at least a portion of the main body to accommodate a size of the head of the user in response to adjusting a length of the adjustable strap.

5. The illuminating face protection device of claim 1, further comprising:

a power button disposed on at least a portion of the main body to turn on the top illuminating unit in response to depressing the power button a first time, turn on the first side illuminating unit and the second side illuminating unit in response to depressing the power button a second time, turn off the top illuminating unit while the first side illuminating unit and the second side illuminating unit remain on in response to depressing the power button a third time, and turn off the first side illuminating unit and the second side illuminating unit in response to depressing the power button a fourth time.

* * * * *